US007544116B1

(12) United States Patent
Lin

(10) Patent No.: US 7,544,116 B1
(45) Date of Patent: Jun. 9, 2009

(54) GRINDER WITH EASILY REPLACING GRINDING TOOL

(75) Inventor: Freddy Lin, Taichung Hsien (TW)

(73) Assignee: Gison Machinery Co., Ltd., Taichung Hsien (TW)

( * ) Notice: Subject to any disclaimer, the term of this patent is extended or adjusted under 35 U.S.C. 154(b) by 58 days.

(21) Appl. No.: 11/949,608

(22) Filed: Dec. 3, 2007

(51) Int. Cl.
*B24B 55/00* (2006.01)

(52) U.S. Cl. ..... 451/294; 451/359

(58) Field of Classification Search ..... 451/294, 451/295, 356, 358, 359
See application file for complete search history.

(56) References Cited

U.S. PATENT DOCUMENTS

| | | | | |
|---|---|---|---|---|
| 3,129,534 | A * | 4/1964 | Miyabayashi | 451/294 |
| 4,103,460 | A * | 8/1978 | Law | 451/344 |
| 5,718,621 | A * | 2/1998 | Turley | 451/342 |
| 6,752,704 | B1 | 6/2004 | Lin | |
| 6,752,705 | B1 * | 6/2004 | Lin | 451/295 |
| 6,887,141 | B1 | 5/2005 | Lin | |
| 7,014,548 | B1 | 3/2006 | Lin | |
| 7,128,641 | B1 | 10/2006 | Lin | |
| 7,175,513 | B2 * | 2/2007 | Folin | 451/359 |
| 7,179,156 | B2 | 2/2007 | Lin | |
| 7,252,580 | B2 | 8/2007 | Lin | |
| 7,311,588 | B1 * | 12/2007 | Lin et al. | 451/359 |
| 2007/0141967 | A1 * | 6/2007 | Kobayashi | 451/359 |

* cited by examiner

*Primary Examiner*—Robert Rose
(74) *Attorney, Agent, or Firm*—Ming Chow; Sinorica, LLC

(57) ABSTRACT

A grinder has a main body formed with a shaft chamber and a rotary shaft rotatably mounted in the shaft chamber. One end of the rotary shaft outward protrudes from the main body for installing a grinding tool thereon. A passage and a slide way are formed in the main body. One end of the passage communicates with the shaft chamber. A front end of the slide way communicates with the passage. A chucking button is disposed in the passage. A link is movably arranged in the slide way. An activation switch is mounted on the main body for controlling the operation of the grinder. When the grinder is not activated, the chucking button can be pressed to chuck the rotary shaft for easy replacement of a grinding tool. When the activation switch is switched on to activate the grinder, the link is chucked in the chucking button to prevent the chucking button from being pressed. Accordingly, when the grinder operates, the chucking button cannot chuck the rotary shaft so as to ensure safety. When the rotary shaft is chucked by the chucking button, the activation switch cannot be switched on.

19 Claims, 15 Drawing Sheets

GRINDER WITH EASILY REPLACING GRINDING TOOL

FIELD OF THE INVENTION

The present invention is related to a grinding device, and more particularly to a grinder in which the grinding tool can be easily replaced. Moreover, when replacing the grinding tool, the grinder is prevented from being powered on.

BACKGROUND OF THE INVENTION

A conventional grinder has a rotary shaft on which a grinding tool such as a grinding disc or a buffing disc is mounted for grinding a work piece.

In operation, it is necessary to frequently replace the grinding tool. Conventionally, when replacing the grinding tool, a hand tool is used to fix the rotary shaft and prevent the rotary shaft from rotating. Under such circumstance, the grinding tool can be replaced.

However, it is inconvenient to fix the rotary shaft with a specific hand tool. In addition, a user must carry and store the hand tool. In order to solve this problem, the inventor had designed grinders with different kinds of mechanisms for chucking the rotary shaft so that the grinding tool can be easily replaced without using any hand tool. The invention is designed under the same purpose.

SUMMARY OF THE INVENTION

It is therefore a primary object of the present invention to provide a grinder in which the grinding tool can be easily replaced.

It is a further object of the present invention to provide the above grinder which has a secure design, the grinder is prevented from being incautiously activated when replacing the grinding tool.

The present invention can be best understood through the following description and accompanying drawings wherein:

DETAILED DESCRIPTION OF THE PREFERRED EMBODIMENTS

Figure 1:
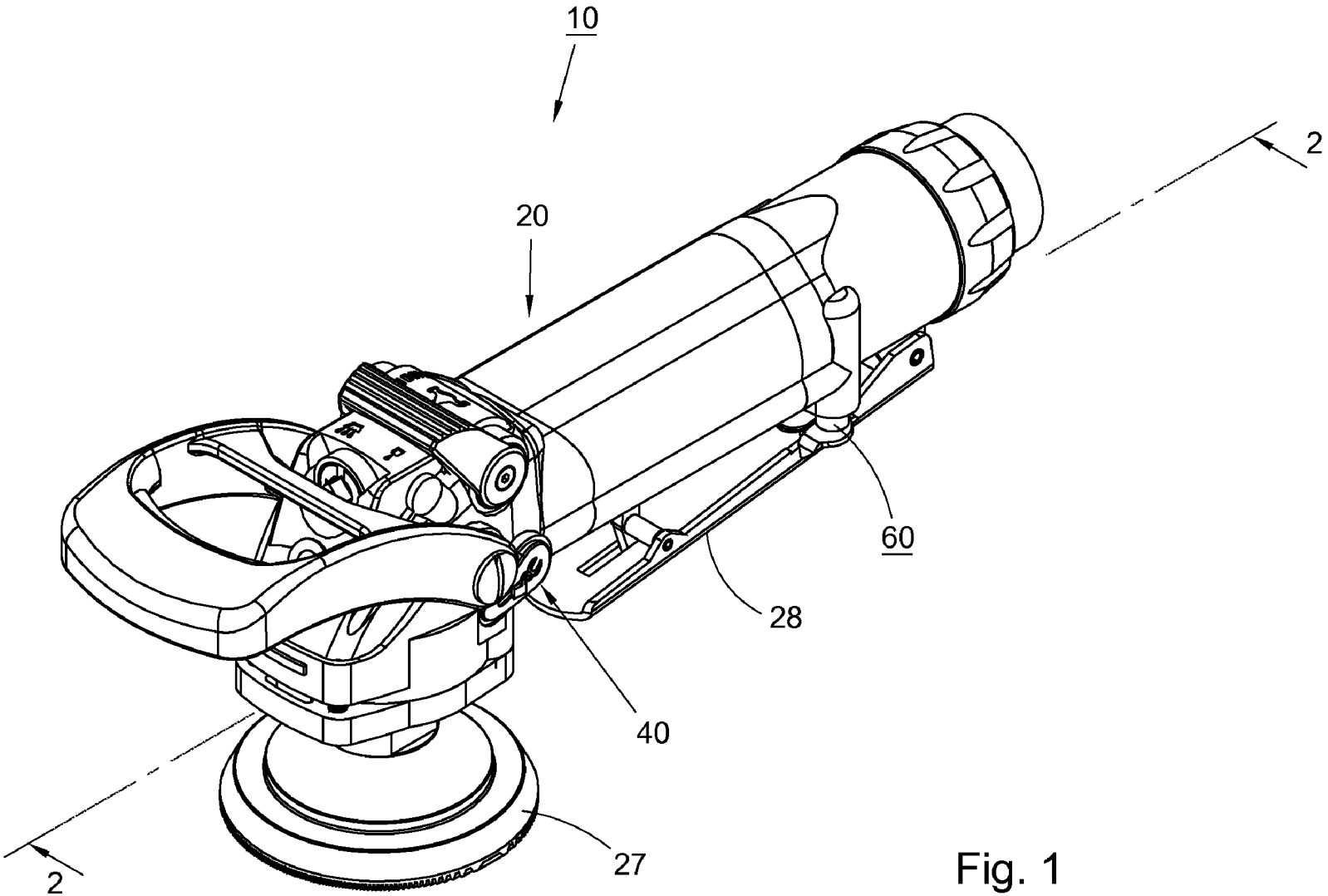
FIG. 1 is a perspective view of a first embodiment of the present invention.
Figure 2:
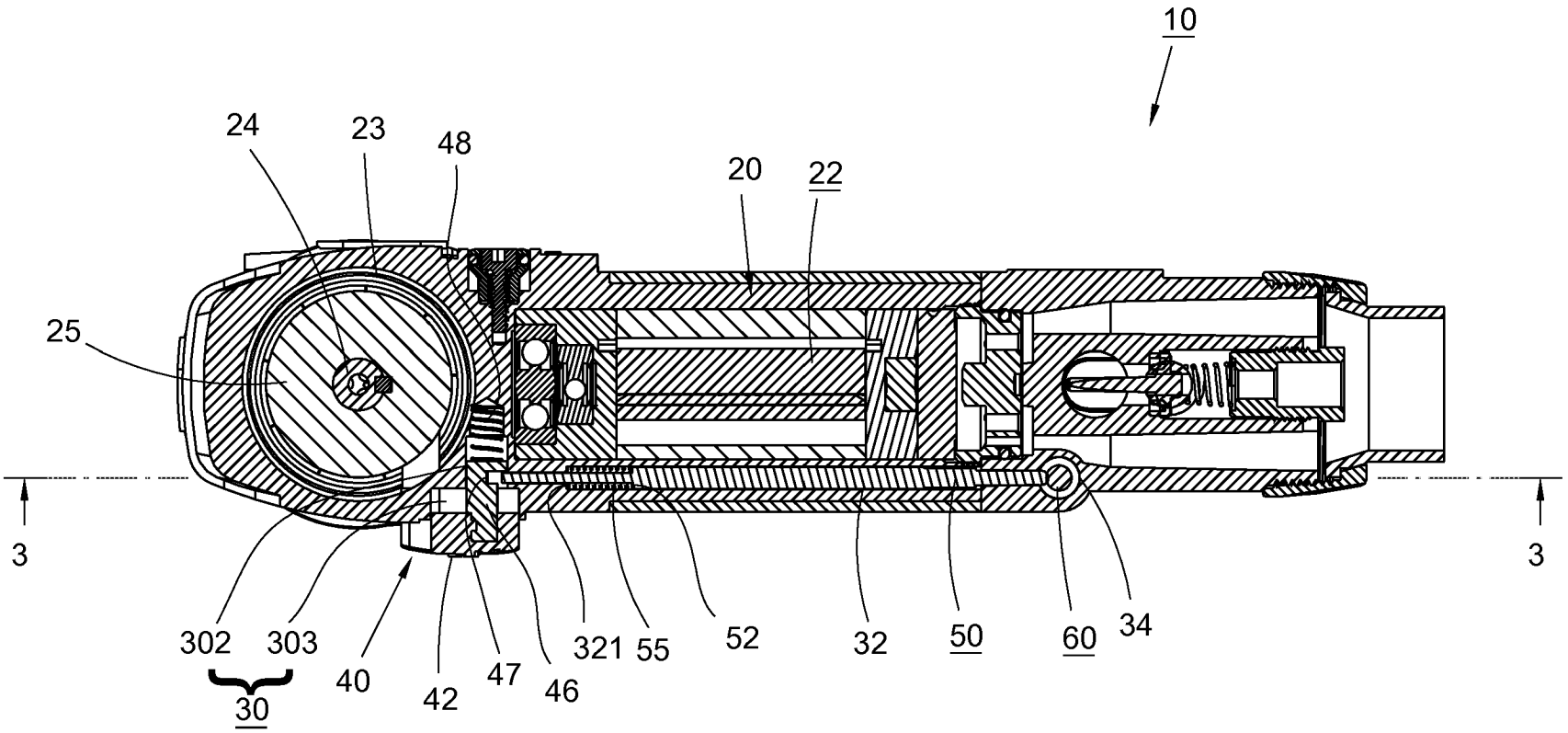
FIG. 2 is a sectional view taken along line 2-2 of FIG. 1.

Please refer to FIGS. 1 and 2. According to a first embodiment, the grinder 10 of the present invention is a pneumatic grinder. However, the design of the present invention is also applicable to an electric grinder.

The grinder 10 includes an elongated main body 20. A rear end of the main body 20 is connected to a power source. (The power source of the pneumatic grinder is high-pressure gas, while the power source of the electric grinder is electricity.) A driving mechanism 22 such as a rotor or a motor is arranged in the main body. A rotary shaft 24 is rotatably mounted in a shaft chamber 23 of the main body 20. A transmission section 25 such as a bevel gear is fixedly connected with the rotary shaft 24 and connected to the driving mechanism 22. One end of the rotary shaft 24 outward protrudes from the main body for installing a grinding tool 27 thereon. An activation switch which is a trigger 28 in this embodiment is pivotally arranged on the circumference of the main body 20, such as on a bottom face or a top face thereof. The trigger 28 is movable between an activation position and a shutoff position. When the trigger 28 is positioned in the activation position, the grinder is powered on to operate the driving mechanism 22 for driving the rotary shaft 24 to rotate to process a work piece.

Figure 3:
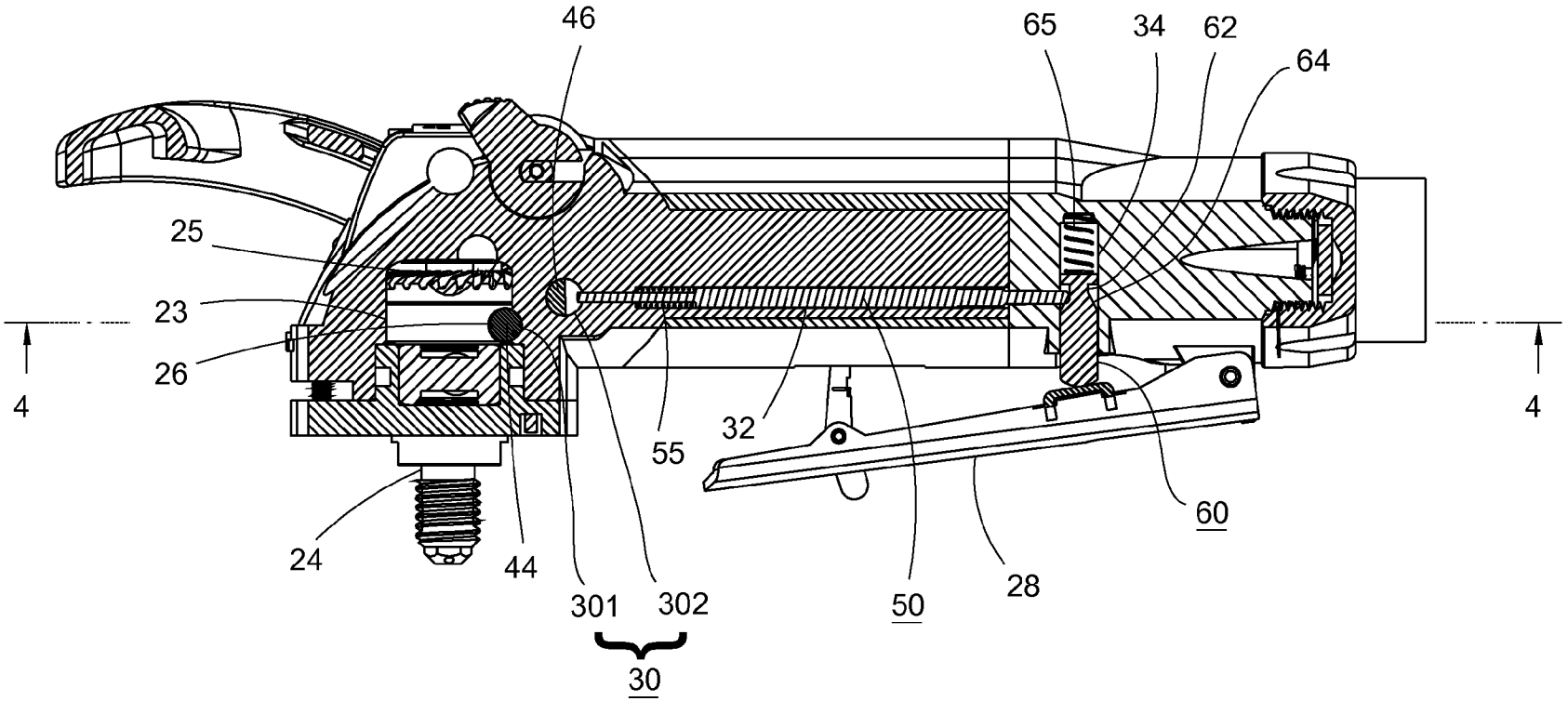
FIG. 3 is a sectional view taken along line 3-3 of FIG. 2.
Figure 4:
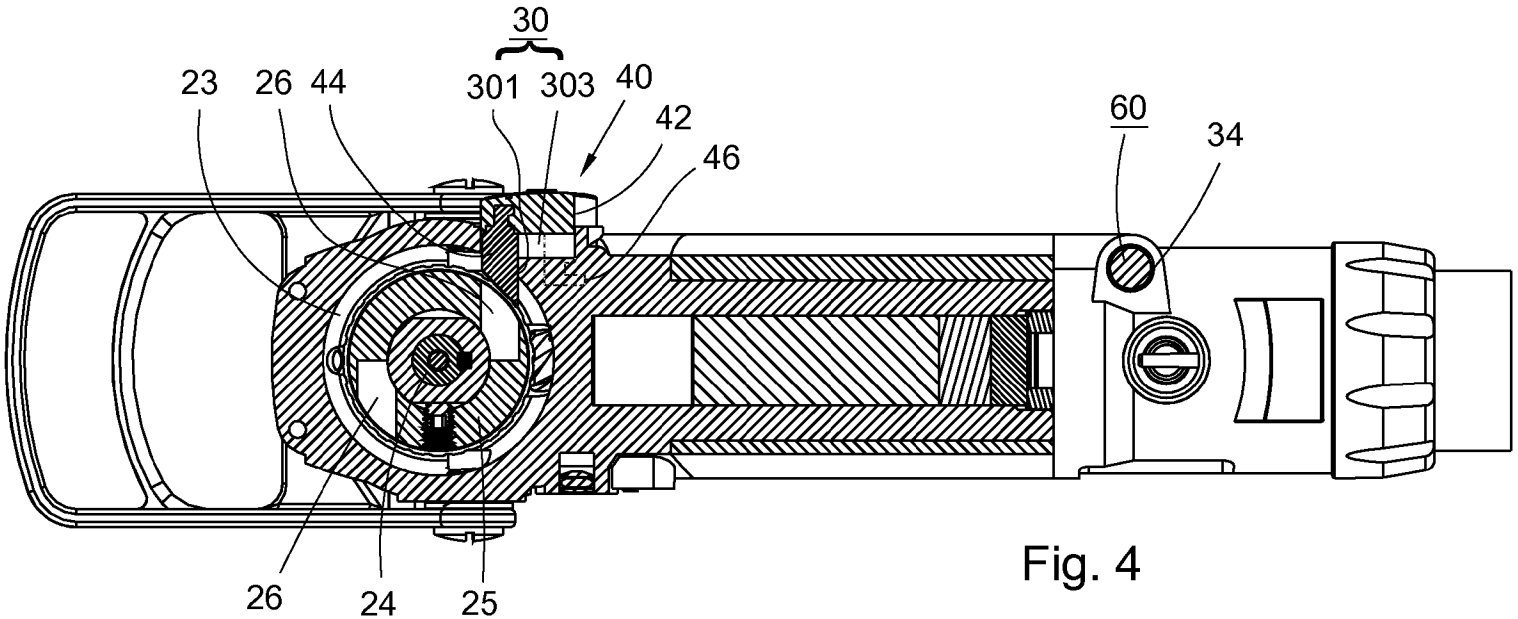
FIG. 4 is a sectional view taken along line 4-4 of FIG. 3.

Referring to FIGS. 2 to 4, a passage 30 is transversely formed in the main body 20 to intersect the shaft chamber 23. As shown in FIGS. 2 and 3, a slide way 32 is longitudinally formed in the main body 20. A front end of the slide way 32 communicates with the passage 30. A conduit 34 is formed in the main body. The conduit 34 has an open end directed to the trigger 28. To speak more detailedly, the passage 30 has a first portion 301 and a second portion 302 in parallel to each other as shown in FIGS. 2 to 4. An inner end of the first portion 301 communicates with the shaft chamber 23. The front end of the slide way 32 communicates with the second portion 302. The passage 30 further has a cavity 303 formed on a circumference of the main body to communicate with outer ends of the two portions 301, 302.

Figure 5:
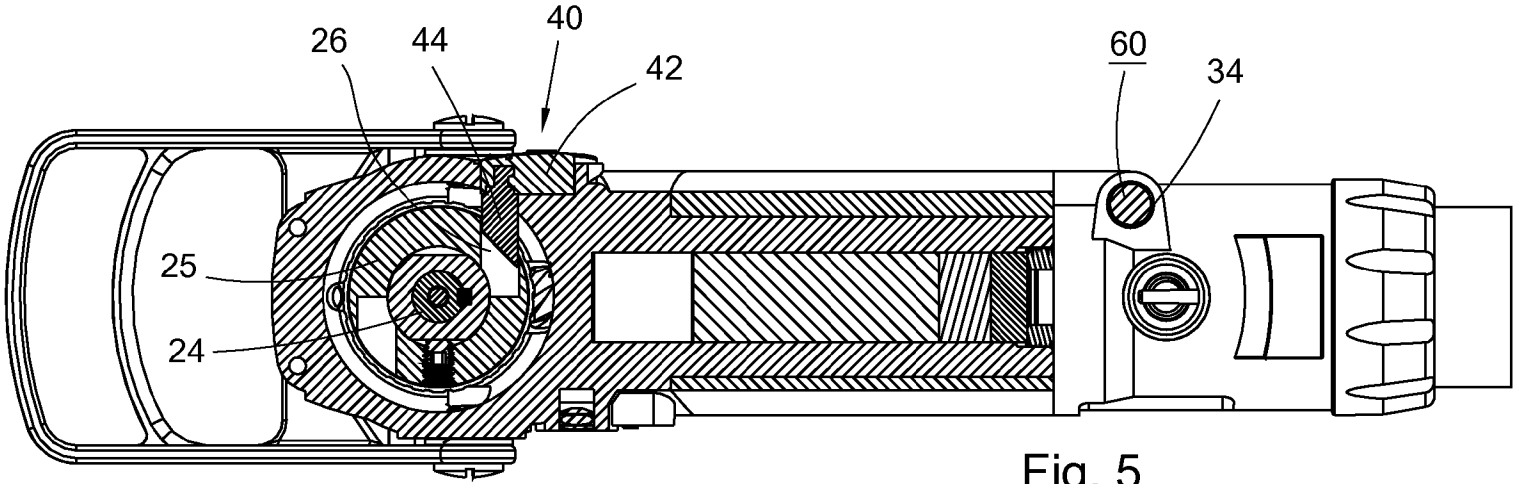
FIG. 5 is a sectional view according to FIG. 4, showing that the chucking button chucks the rotary shaft.

A chucking button 40 which in this embodiment has a button section 42, a first rod body 44 and a second rod body 46 in parallel to the first rod body 44. The rod bodies 44, 46 are connected with the button section 42. A dented chucking section 47 is formed on the circumference of a rear side of the second rod body 46. The chucking button 40 is fitted in the passage 30 of the main body 20. The first rod body 44 is fitted in the first portion 301 of the passage as shown in FIGS. 2 and 3, while the second rod body 46 is fitted in the second portion 302 as shown in FIGS. 3 and 4. The button section 42 is accommodated in the cavity 303. The chucking button 40 is movable between a chucking position as shown in FIG. 5 and a releasing position as shown in FIGS. 2 and 4. A resilient member 48 is positioned in the second portion 302 of the passage to resiliently abut against the second rod body 46 of the chucking button. In normal state, the chucking button 40 is outward forced by the resilient member 48 and positioned in the releasing position.

A link 50 is mounted in the slide way 32 of the main body and slidable along the slide way. A resilient member 55 is fitted on the link 50. Two ends of the resilient member 55 respectively abut against a shoulder section 52 of the link and a shoulder section 321 of the slide way. The resilient member 55 always resiliently forces the link 50 toward a rear end of the main body.

An operation rod 60 is mounted in the conduit 34 of the main body and slidable along the conduit 34. The circumference of the operation rod 60 is formed with a small diameter section 62 and a conic section 64 connected with the small diameter section. A resilient member 65 is mounted in the conduit 34. In normal state, the operation rod 60 is outward forced by the resilient member 65 and positioned in a releasing position, whereby an outer end of the operation rod 60 protrudes out of the conduit 34 to contact with the trigger 28.

The transmission section 25 of the rotary shaft 24 is further formed with two engaging sections 26 which are two caves as shown in FIG. 4.

The operation of the present invention will be described hereinafter.

Referring to FIG. 3, when the trigger 28 is positioned in the shutoff position, the grinder 20 is not activated. At this time, the operation rod 60 is positioned in the releasing position where the small diameter section 62 is aligned with a rear end of the slide way 32. Under such circumstance, there is room for the link 50 to move rearward. Accordingly, the link 50 is pushed by the resilient member 55 to move rearward to a releasing position. The rear end of the link 50 is moved into the conduit 34 to contact with the small diameter section 62 of the operation rod 60. Under such circumstance, referring to FIG. 2, the chucking button 40 is free from the hindrance of the link 50, and is movable between the releasing position and the chucking position. When not pressed, the chucking button 40 is pushed by the resilient member 48 and held in the releasing position. At this time, the chucking section 47 of the second rod body 46 of the chucking button is right aligned with the front end of the slide way 32.

When the grinder is not activated, a user can replace the grinding tool. The user can hold the grinder with one hand and press the chucking button 40 to move the chucking button 40 into the main body 20 toward the chucking position as shown in FIG. 5. At this time, the first rod body 44 of the chucking button is inserted into one of the engaging sections 26 of the rotary shaft 24. The rotary shaft is therefore fixed and cannot be rotated. Accordingly, the user can replace the grinding tool with the other hand.

Figure 6:
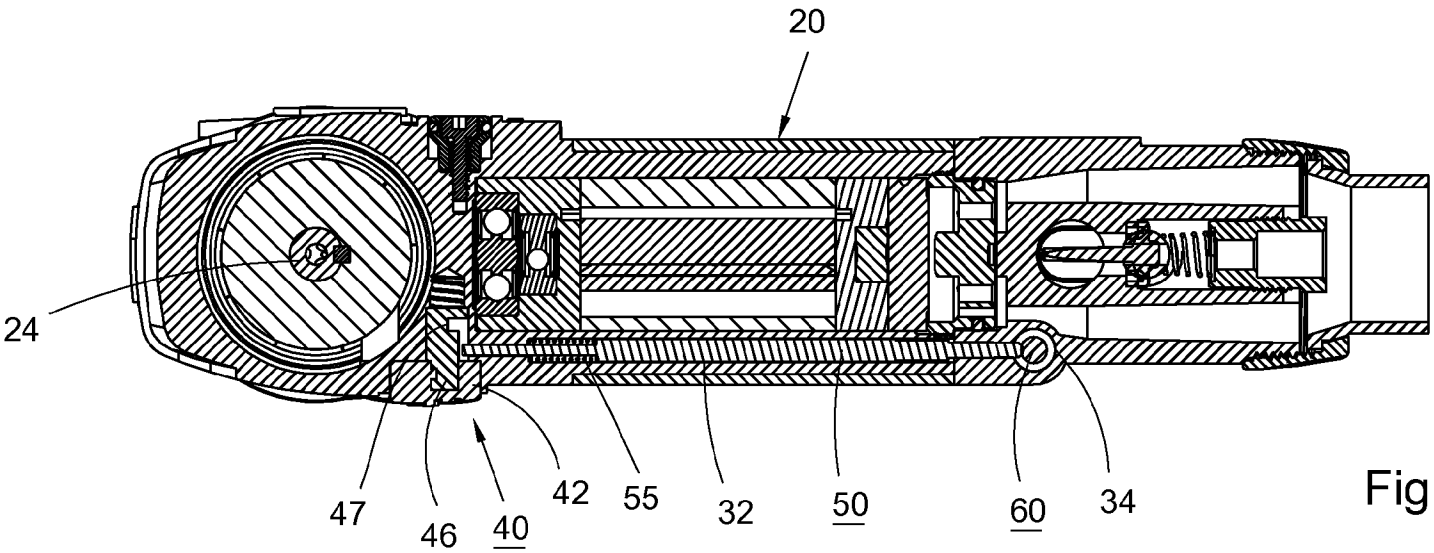
FIG. 6 is a sectional view according to FIG. 2, showing that the chucking button is positioned in the chucking position.

Referring to FIG. 6, when the chucking button is positioned in the chucking position, the chucking section 47 of the second rod body 46 is no longer aligned with the front end of the slide way 32. Therefore, the link 50 is hindered by the second rod body 46 from moving forward. Accordingly, when the chucking button chucks the rotary shaft, the link 50 cannot move forward so that the trigger 28 cannot be triggered. Therefore, the grinder cannot be activated to ensure safety.

After the replacement is accomplished, the chucking button is released from being pressed, whereby the chucking button resiliently restores to the releasing position as shown in FIG. 4, the chucking button is disengaged from the rotary shaft.

Figure 7:
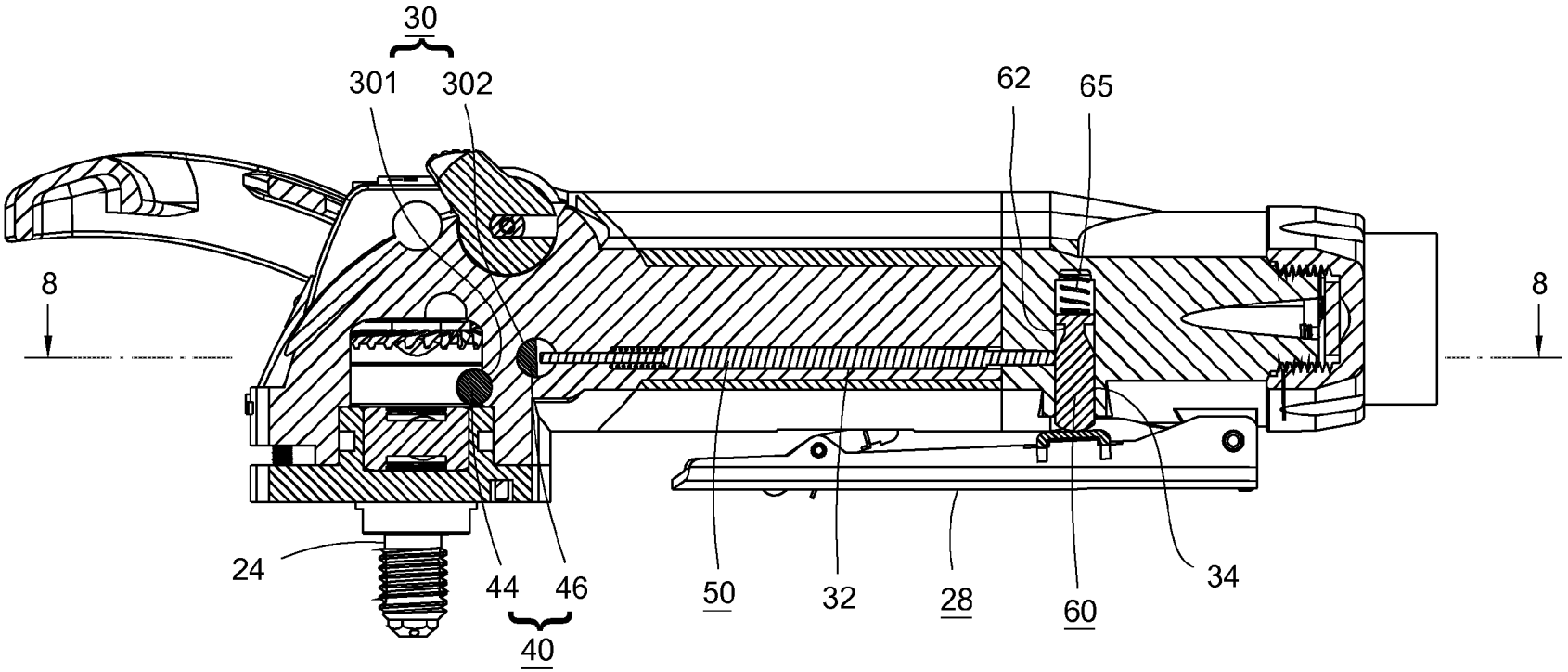
FIG. 7 is a sectional view according to FIG. 3, showing that the trigger is pulled.

When the chucking button 40 is positioned in the releasing position, the rotary shaft 24 is not engaged with the chucking button. At this time, the chucking section 47 of the second rod body 46 provides a space for the link 50 to more forward. Under such circumstance, the trigger 28 can be pulled to the activation position as shown in FIG. 7 to activate the grinder. When the trigger 28 is positioned in the activation position, the operation rod 60 is driven and moved upward by the trigger to an operation position where the small diameter section 62 no more contacts with the link 50. Instead, the body of the operation rod 60 contacts with the rear end of the link 50, the operation rod pushes the link forward to a chucking position whereby the front end of the link is chucked in the chucking section 47 of the chucking button 40 as shown in FIG. 8.

Figure 8:
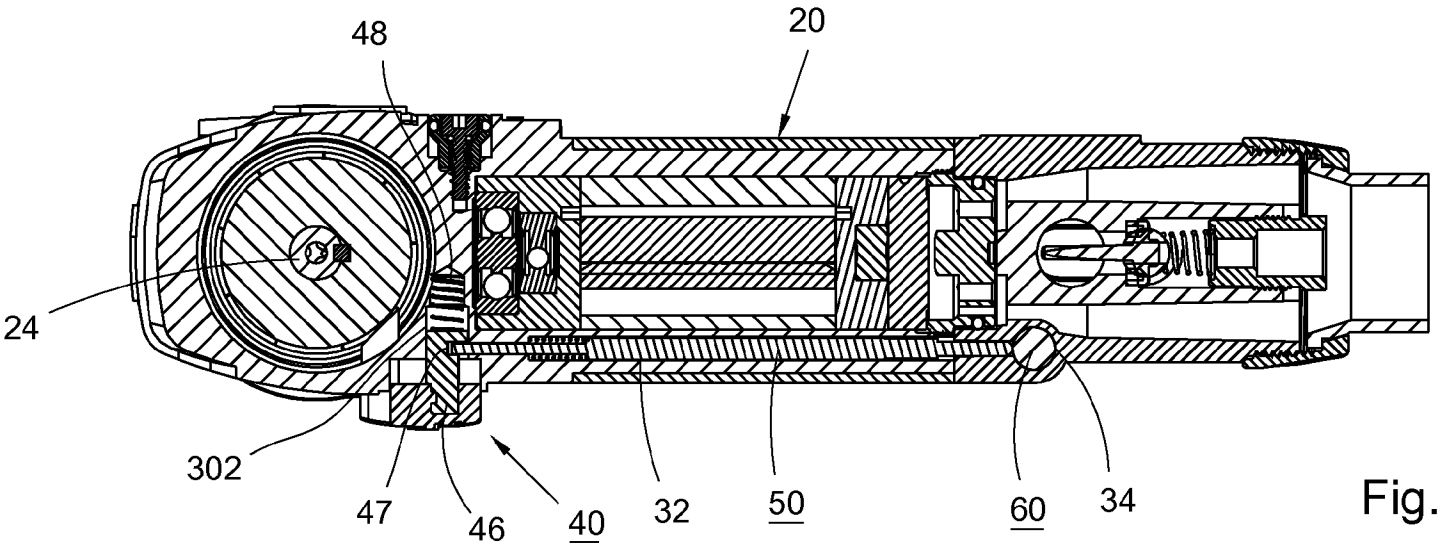
FIG. 8 is a sectional view taken along line 8-8 of FIG. 7.

When the grinder operates, the link 50 is engaged with the chucking button 40 as shown in FIG. 8. At this time, the chucking button 40 cannot be pressed so that the chucking button will not engage with the rotary shaft in rotation.

When replacing the grinding tool again, it is necessary to first shut off the grinder so that the chucking button can chuck the rotary shaft. When turning on the grinder, it must be that the chucking button is disengaged from the rotary shaft so that the grinder can be activated.

Figure 9:
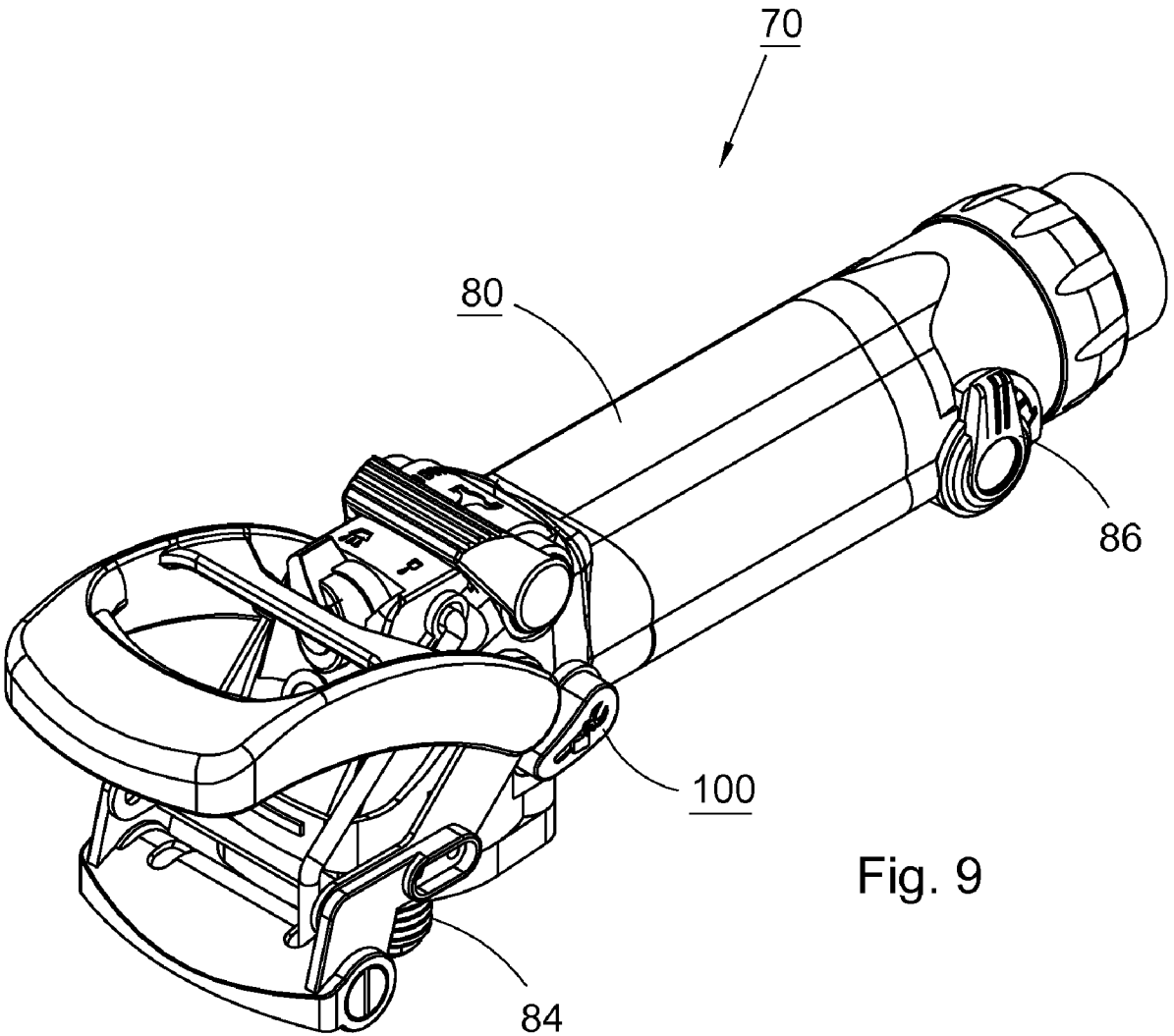
FIG. 9 is a perspective view of a second embodiment of the present invention.
Figure 10:
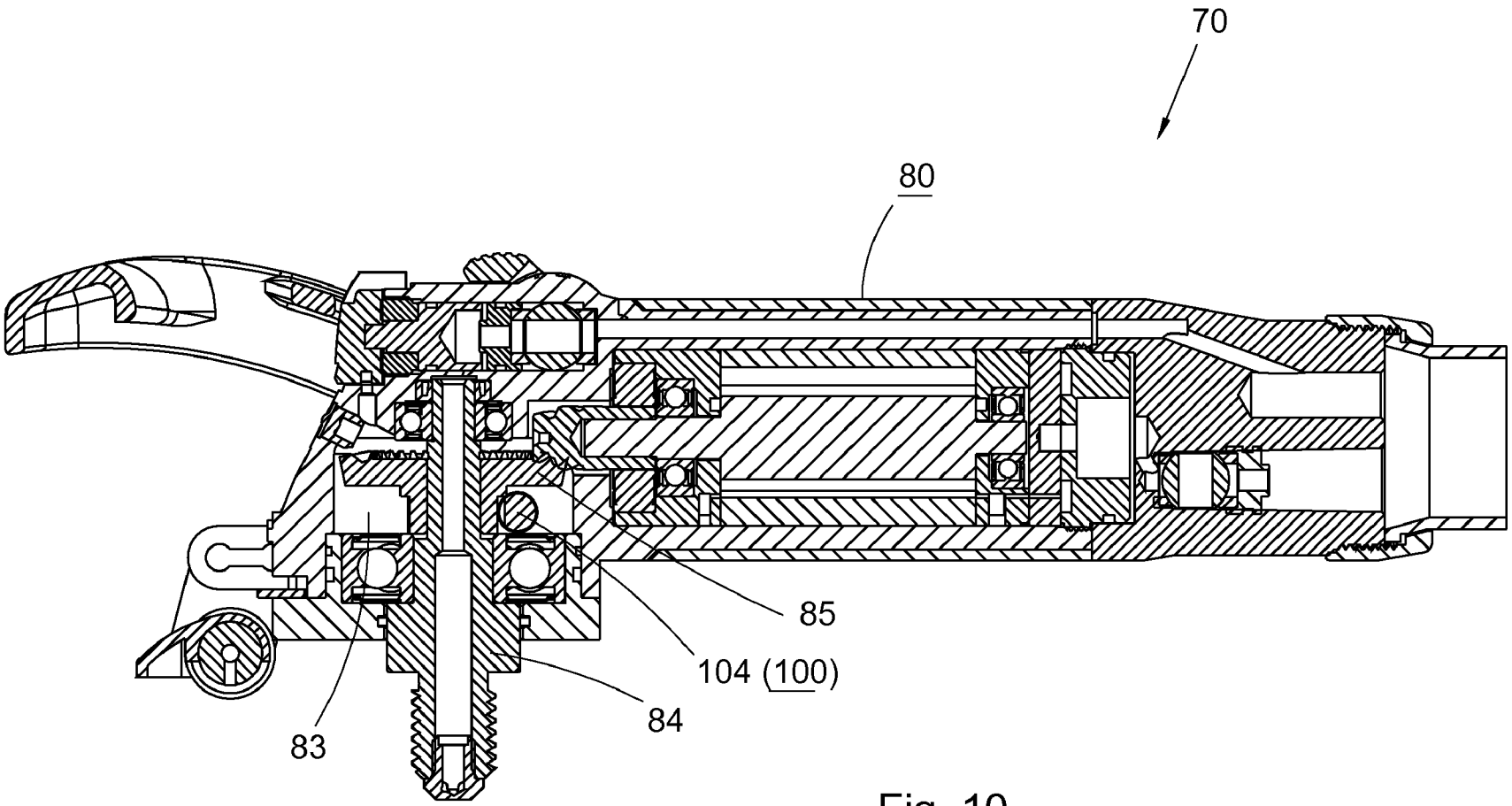
FIG. 10 is a longitudinal sectional view according to FIG. 9.
Figure 12:
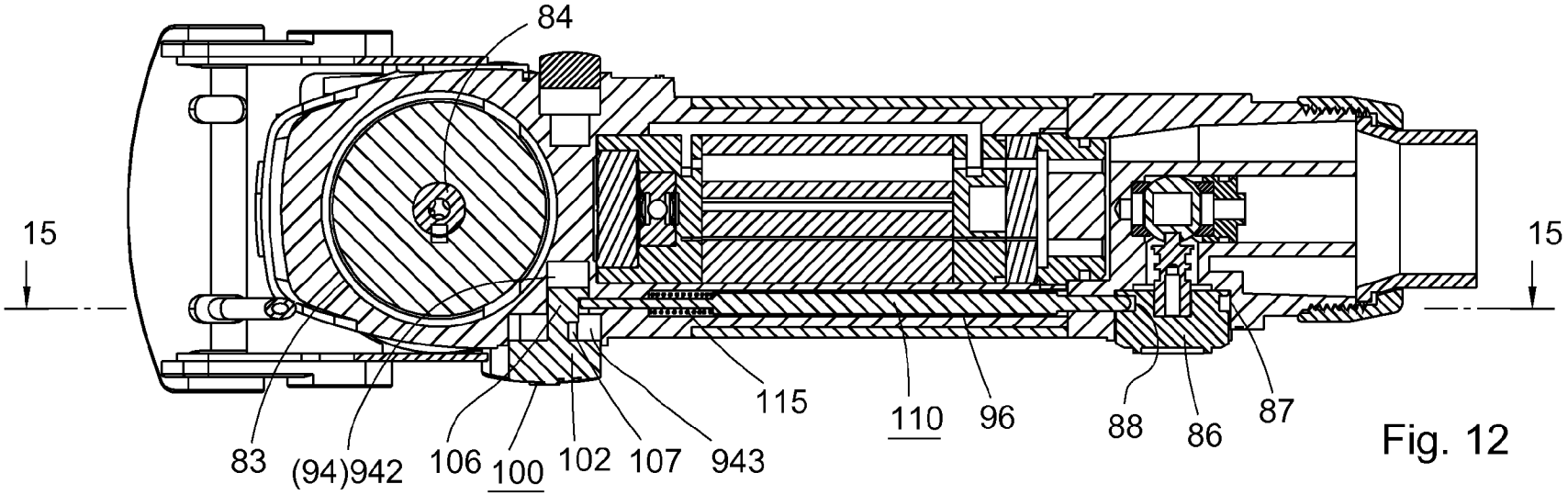
FIG. 12 is a sectional view taken along line 12-12 of FIG. 11.

FIGS. 9, 10 and 12 show a second embodiment of the present invention, which includes a main body 80, an activation switch 86, a chucking button 100 and a link 110. Two dented engaging sections 92 are formed on the circumference of the transmission section 85 of the rotary shaft 84 as shown in FIG. 13.

Figure 15:
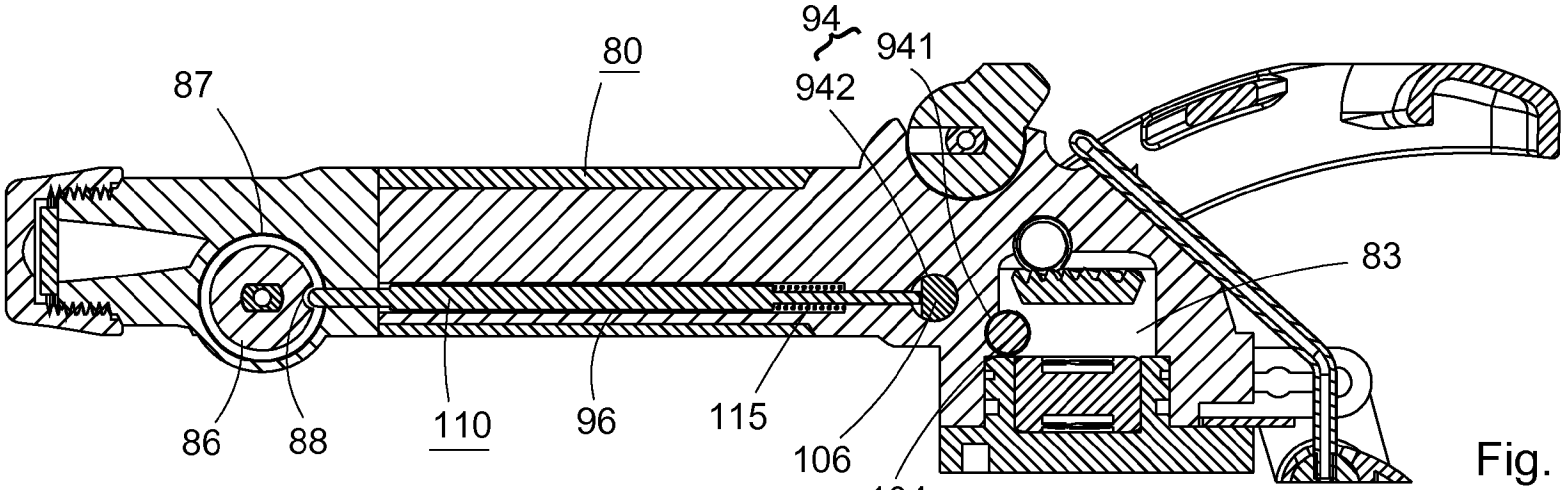
FIG. 15 is a sectional view taken along line 15-15 of FIG. 12.

In this embodiment, the activation switch 86 is a rotary switch rotatably disposed in a switch chamber 87 formed on the circumference of the main body 80 as shown in FIGS. 12 and 15. A recess 88 is formed on the circumference of the switch 86.

Figure 13:
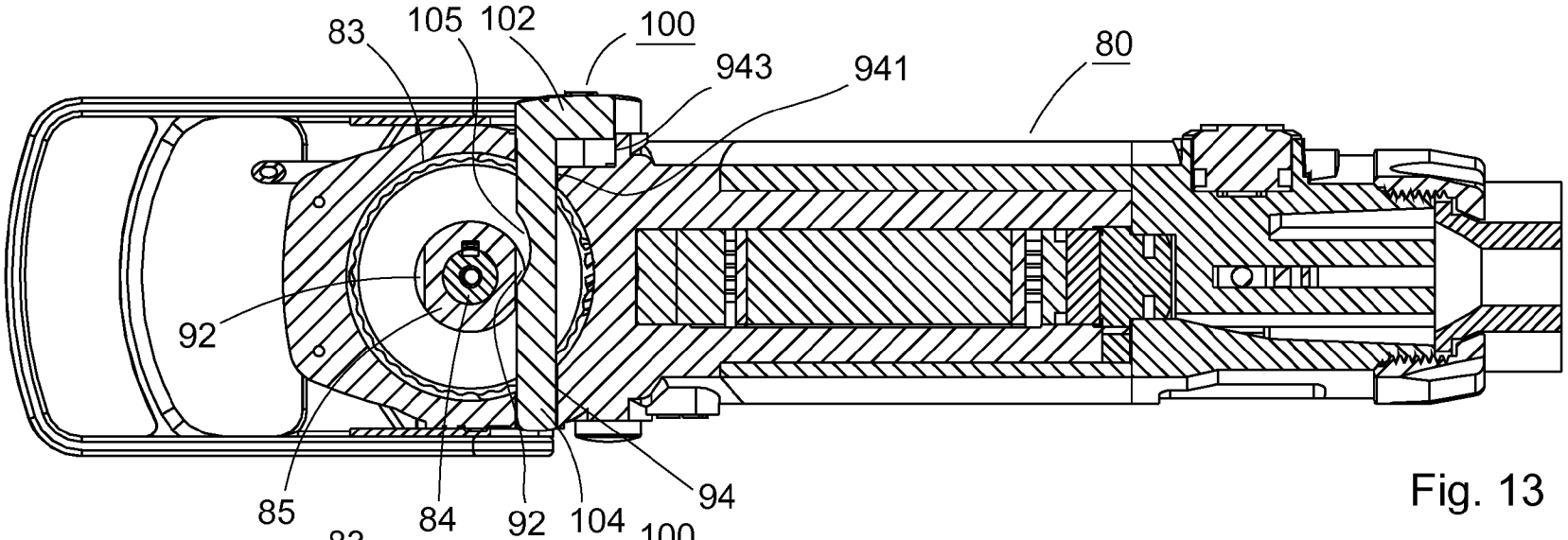
FIG. 13 is a sectional view taken along line 13-13 of FIG. 11, showing that the chucking button chucks the rotary shaft.

The main body is also formed with a passage 94 as shown in FIG. 13 and a slide way 96 as shown in FIGS. 12 and 15. A first portion 941 of the passage communicates with the shaft chamber 83 and passes through the main body from one side to another side thereof. Two ends of the slide way 96 respectively communicate with a second portion 942 of the passage 94 and the switch chamber 87.

Figure 16:
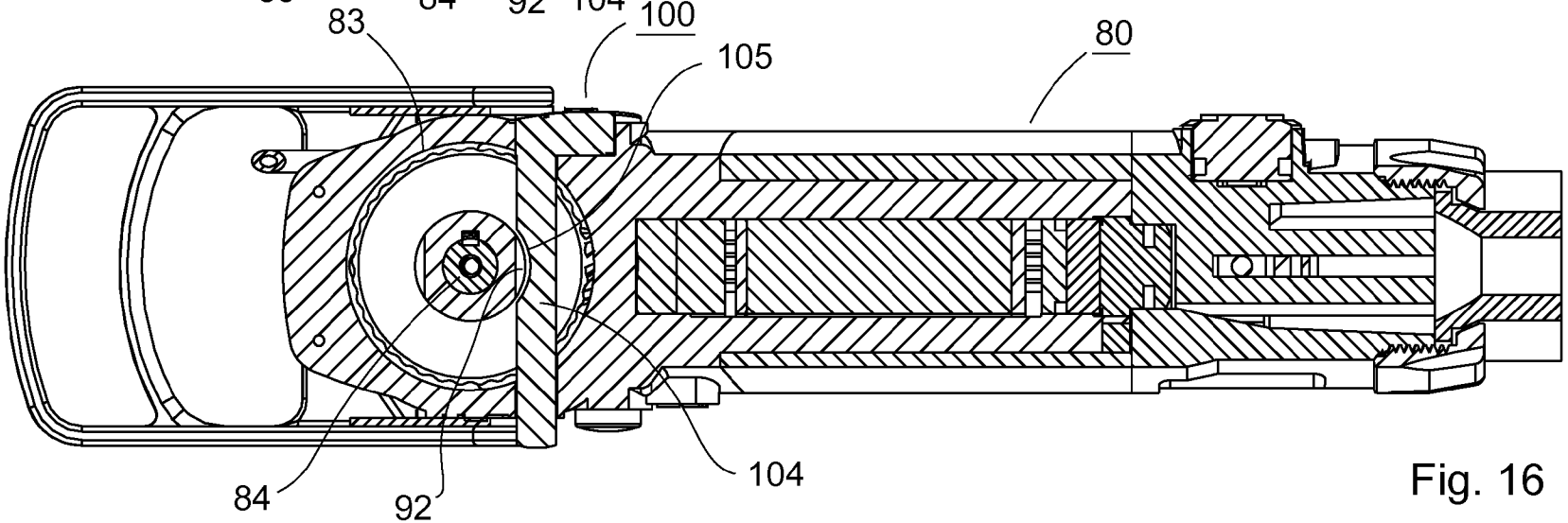
FIG. 16 is a sectional view according to FIG. 13, showing that the chucking button is disengaged from the rotary shaft.
Figure 14:
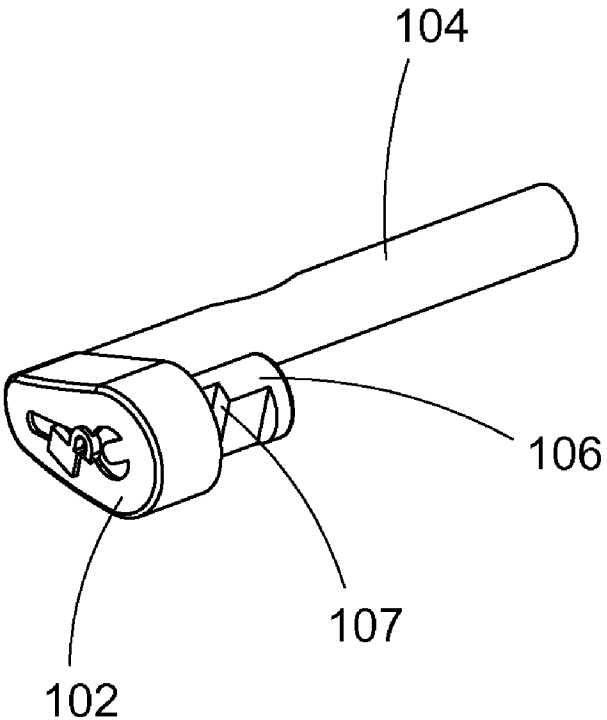
FIG. 14A is a front perspective view of the chucking button.
FIG. 14B is a rear perspective view of the chucking button.
Figure 14:
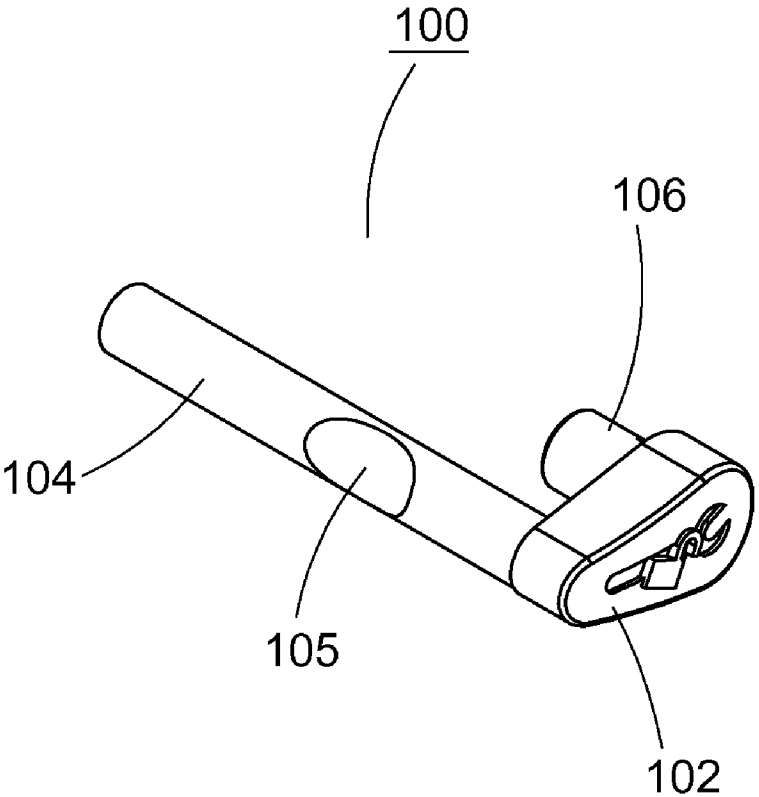

Referring to FIG. 16, the first rod body 104 of the chucking button 100 is an elongated rod body, while the second rod body 106 is a short rod body. A depression 105 is formed on a front side of the elongated rod body 104. A chucking section 107 is formed on a rear side of the short rod body 106. The elongated rod body 104 is fitted through the first portion 941 of the passage 94 to extend into the shaft chamber 83. The short rod body 106 is fitted in the second portion 942 of the passage. In practice, a resilient member can be arranged in the main body for resiliently forcing the chucking button, whereby the chucking button is kept in a releasing position in normal state. The button section 102 of the chucking button 100 is accommodated in a cavity 943 of the passage.

The link 110 is slidable within the slide way 96 and resiliently pushed by a resilient member 115.

Figure 11:
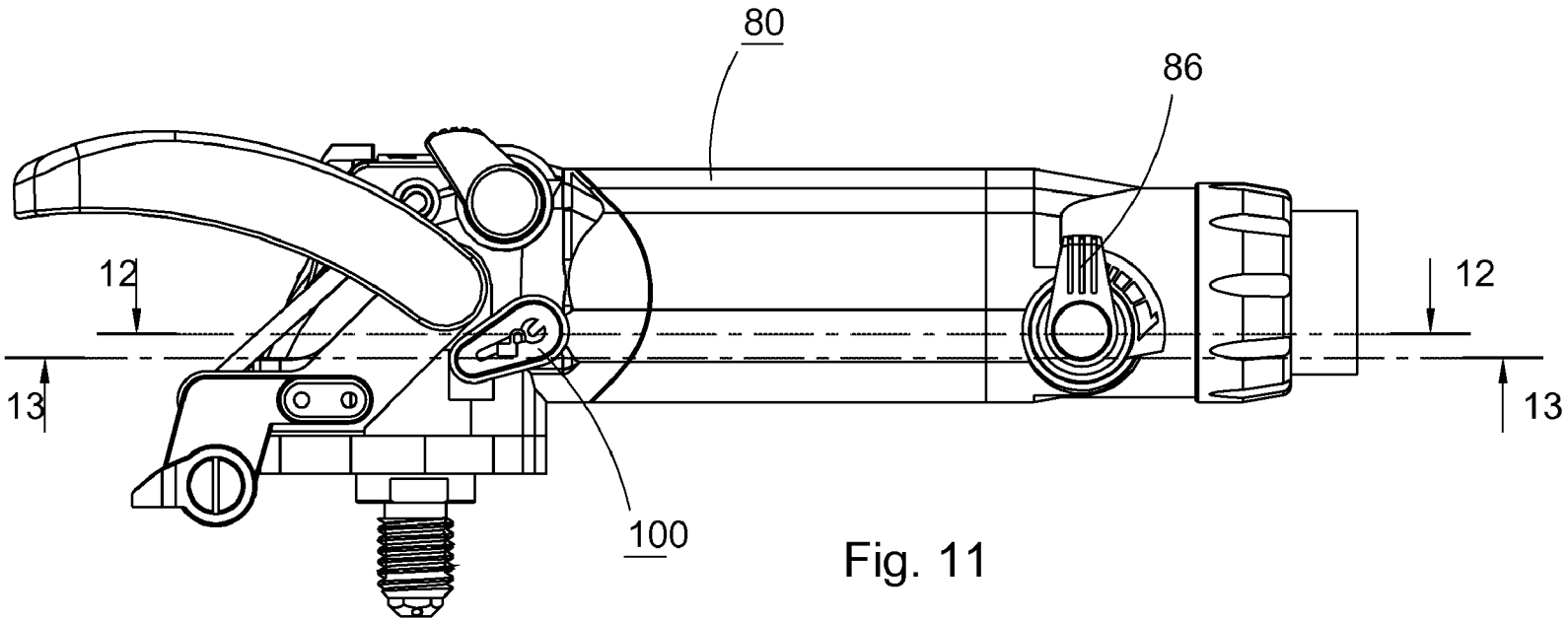
FIG. 11 is a side view according to FIG. 9.

When the activation switch 86 is positioned in a shutoff position as shown in FIG. 11, the power is cut off from the grinder. At this time, as shown in FIGS. 12 and 15, the recess 88 of the switch is aligned with the slide way 96. The link 110 is resiliently pushed by the resilient member 115 to move rearward to a releasing position. The rear end of the link 110 contacts the recess 88 of the switch 86. At this time, the chucking button 110 is free from the hindrance of the front end of the link 110, whereby the chucking button 110 is switchable between a chucking position as shown in FIGS. 12, 13 and a releasing position as shown in FIG. 16.

When the chucking button 110 is switched to the chucking position as shown in FIG. 13, the first rod body 104 of the chucking button is engaged with the engaging section 92 of the rotary shaft, whereby the rotary shaft cannot rotate. Accordingly, the rotary shaft is fixed for replacing the grinding tool.

Furthermore, as shown in FIG. 12, when the chucking button 110 is positioned in the chucking position, the chucking section 107 is not aligned with the front end of the slide way 96. The front end of the link 110 contacts with the rod body 106 of the chucking button so that the link 110 cannot move forward. Therefore, the activation switch 86 cannot be rotated.

Figure 17:
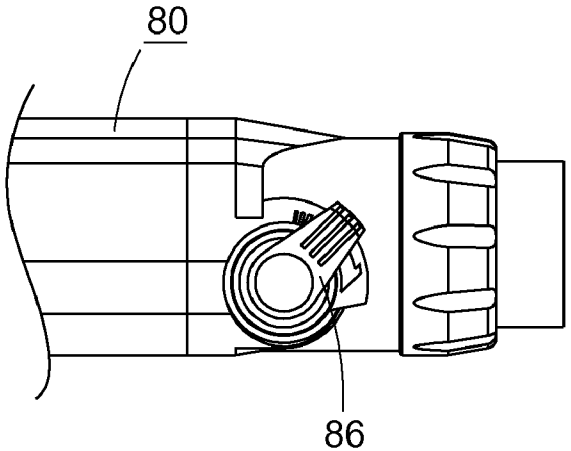
FIG. 17 shows that the activation switch is switched.
Figure 19:
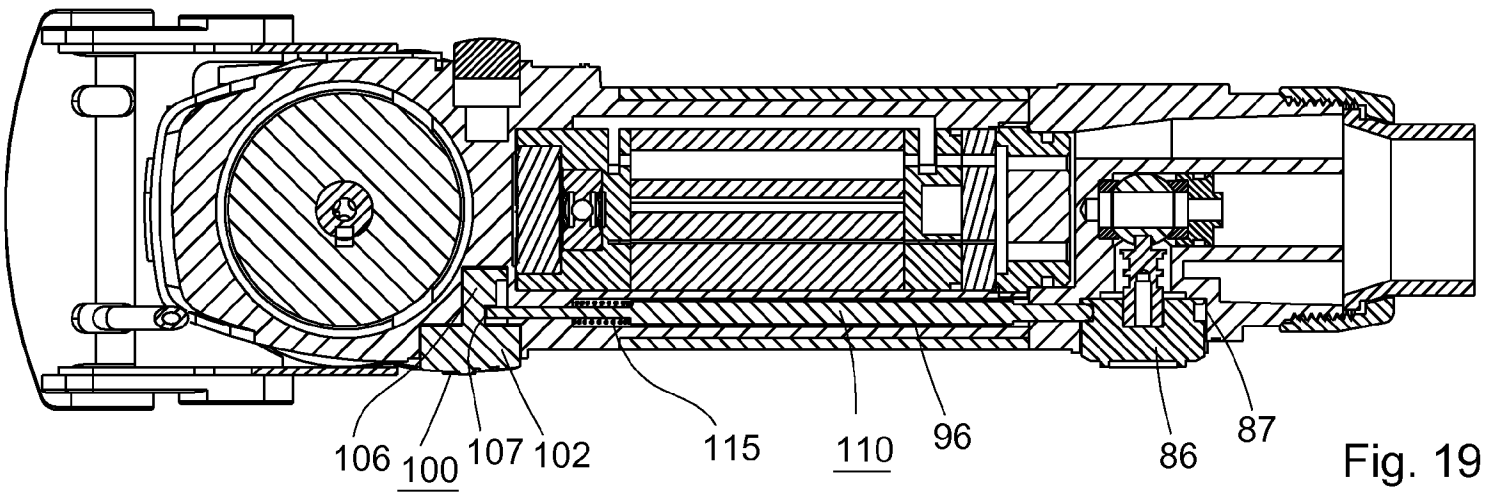
FIGS. 18 and 19 are sectional view according to FIGS. 15 and 12, showing that when the grinder is activated, the chucking button is chucked.
Figure 18:
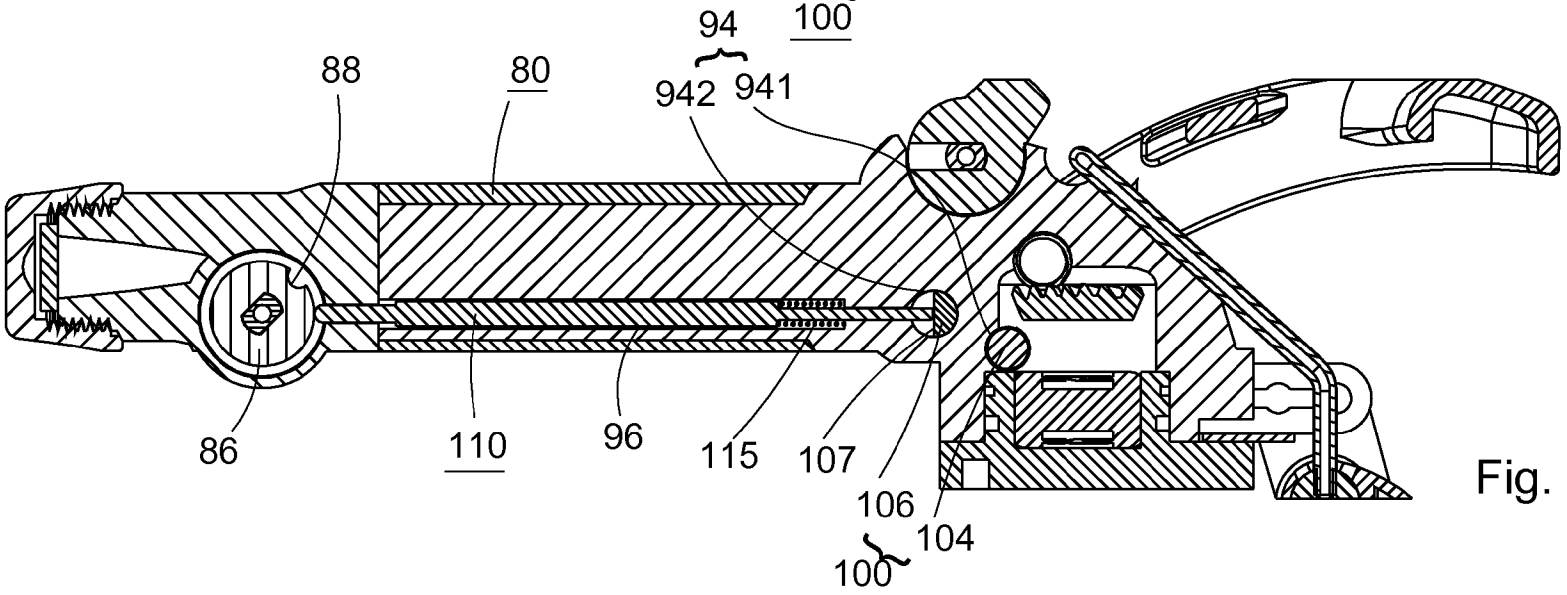

When turning on the grinder, the chucking button 100 must be pressed to the releasing position of FIG. 16, whereby the depression 105 of the chucking button is aligned with the rotary shaft 84 and the chucking button is disengaged from the rotary shaft. Also, as shown in FIG. 19, when the chucking button is positioned in the releasing position, the chucking section 107 is aligned with the slide way 96, whereby there is a space for the link to move forward. Under such circumstance, the switch 86 can be switched to the activation position as shown in FIGS. 17 and 18 for turning on the grinder. When the switch 86 is moved to the activation position, the link 110 is pushed forward to the chucking position where the front end of the link is chucked in the chucking section 107 of the chucking button 100 as shown in FIG. 19. Accordingly, when the grinder operates, the link is engaged with the chucking button so that the chucking button cannot be moved. Only when the grinder is turned off, the chucking button can chuck the rotary shaft. Only when the chucking button is not engaged with the rotary shaft, the switch can be switched.

Figure 21:
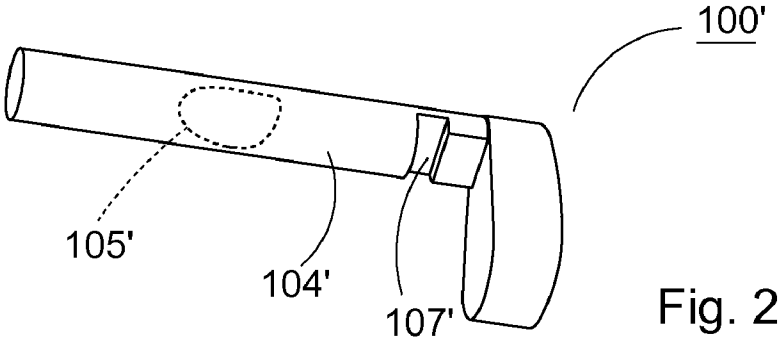
FIG. 21 is a perspective view of the chucking button of FIG. 20.
Figure 20:
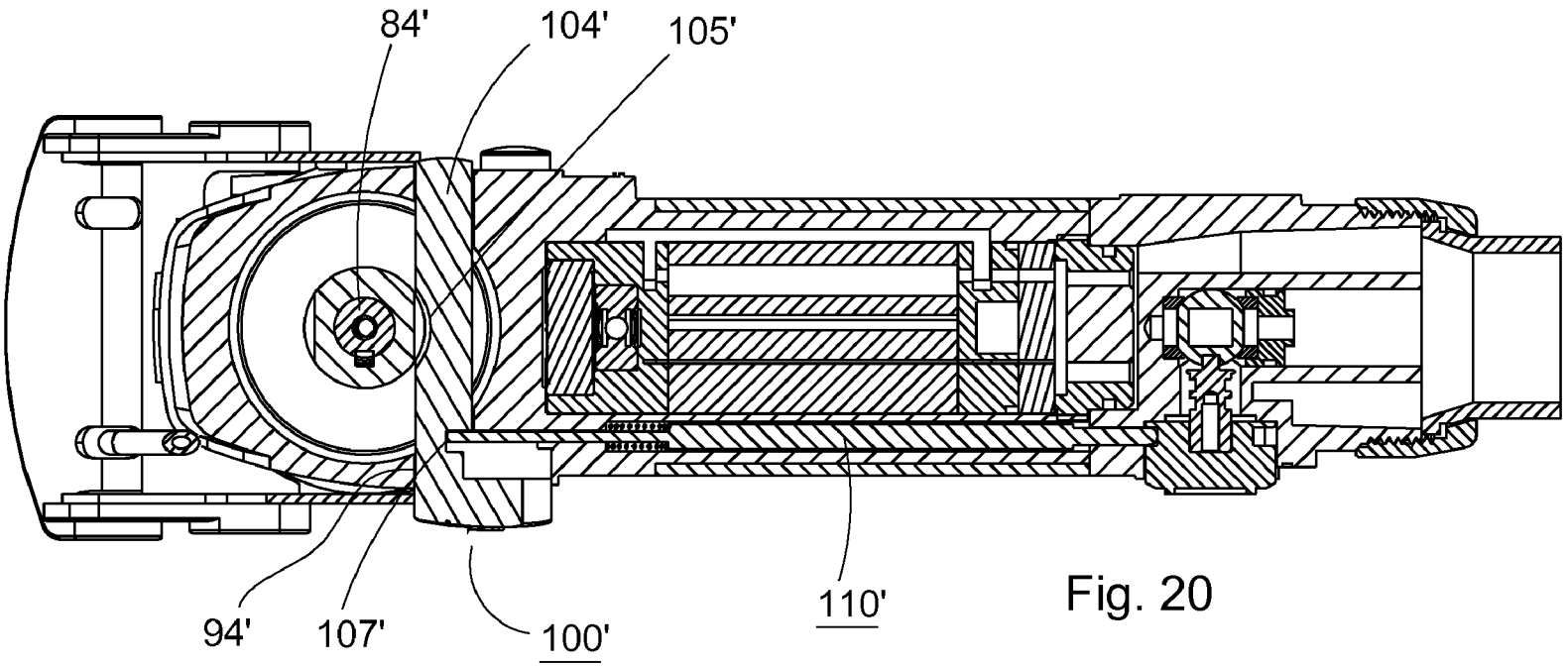
FIG. 20 is a sectional view of a third embodiment of the present invention.

FIGS. 20 and 21 show a third embodiment of the present invention, which is different from the second embodiment in that the chucking button 100' only has one rod body 104' fitted in the passage 94'. A depression 105' is formed on a front side of the rod body and a chucking section 107' is formed on a rear side of the rod body for engaging with the rotary shaft 84' and chucking the link 110'. The operation of the embodiment is identical to that of the second embodiment.

In the first embodiment, the chucking button can alternatively have only one rod body.

Figure 22:
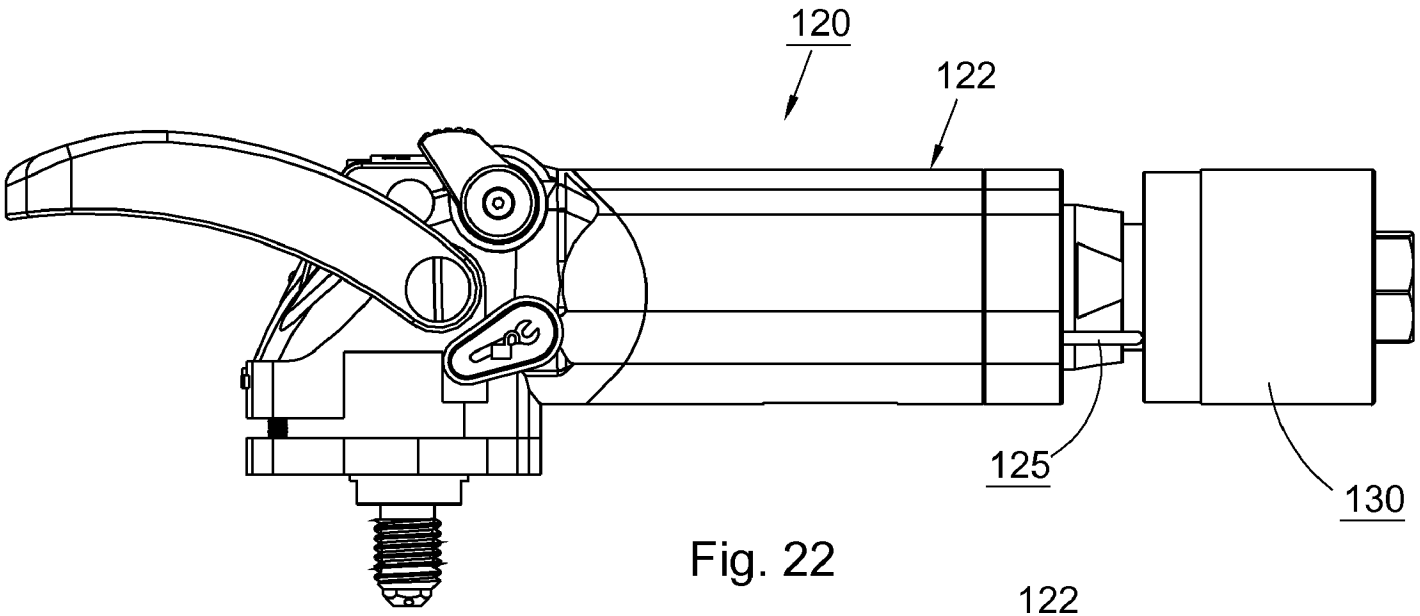
FIGS. 22 and 23 are side views of a fourth embodiment of the present invention, respectively showing that the activation switch is positioned in the shutoff position and in the activation position.

FIG. 22 shows a fourth embodiment of the grinder 120 of the present invention. The activation switch of the fourth embodiment is different from the activation switch of any of the above embodiments. The other components of this embodiment, such as the chucking button and the link, are identical to those of the above embodiments and thus will not be repeatedly described hereinafter.

The activation switch 130 is mounted at a rear end of the main body 122 and is movable along the axis of the main body. The rear end of the link 125 is aligned with a front end face of the activation switch. FIG. 22 shows that the switch 130 is positioned in a shutoff position. Under such circumstance, the link 125 is positioned in a releasing position without chucking the chucking button.

Figure 23:
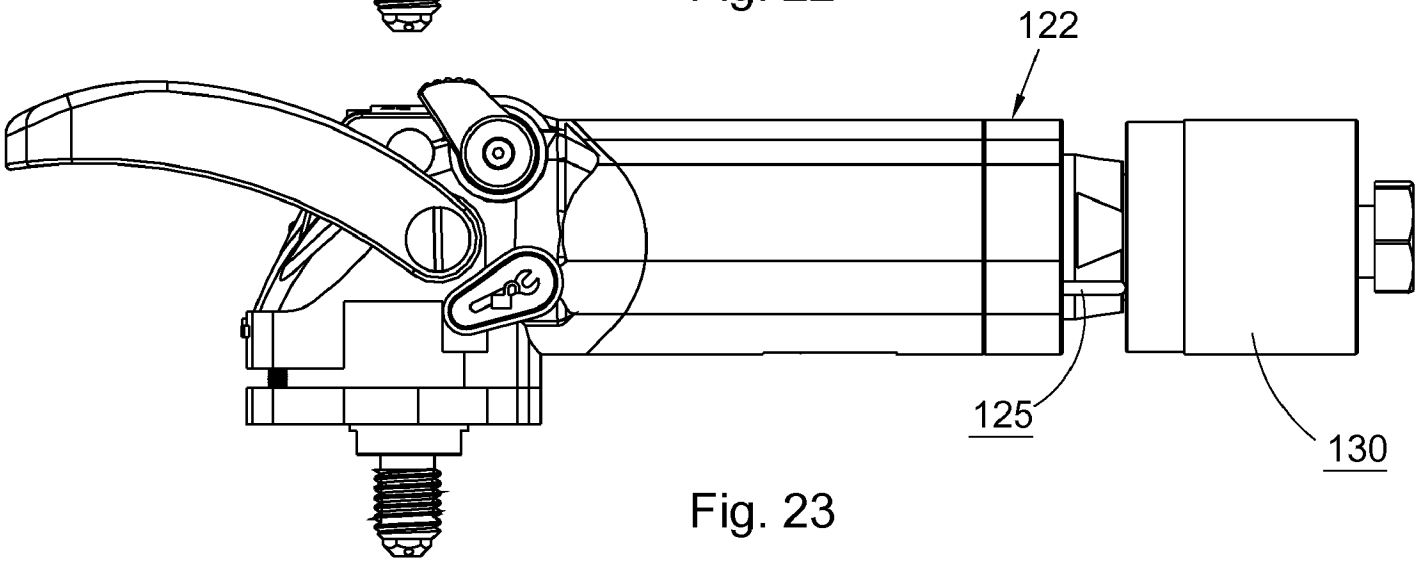

When turning on the grinder, the switch 130 is pushed forward and located in an activation position as shown in FIG. 23. Under such circumstance, the link 125 is pushed by the switch 130 to move forward to the engaging position whereby the link 125 is engaged with the chucking button. In this embodiment, the switch is back and forth movable for pushing and releasing the link.

According to the above arrangement of the present invention, a user only needs to press the chucking button for fixing the rotary shaft without using any tool. Therefore, the replacement of the grinding tool is facilitated. Also, the grinder of the present invention provides a secure effect. That is, when replacing the grinding tool, it is impossible to turn on the grinder. When the grinder operates, the chucking button is prevented from chucking the rotary shaft.

The above embodiments are only used to illustrate the present invention, not intended to limit the scope thereof. Many modifications of the above embodiments can be made without departing from the spirit of the present invention.

What is claimed is:

1. A grinder with easily replacing grinding tool, comprising:

an elongated main body, a shaft chamber being formed in a front end of the main body; an activation switch being arranged on the main body and switchable between an activation position and a shutoff position; a passage being transversely formed in the main body to intersect the shaft chamber; a slide way being longitudinally formed in the main body, a front end of the slide way communicating with the passage;

a rotary shaft rotatably mounted in the shaft chamber, one end of the rotary shaft outward protruding from the main body for installing a grinding tool thereon; at least one engaging section being disposed on the rotary shaft;

a chucking button having at least one rod body, a chucking section being formed on a circumference of the rod body, the rod body of the chucking button being fitted in the passage and movable between a chucking position and a releasing position; when the chucking button is positioned in the chucking position, the rod body being engaged with the engaging section of the rotary shaft; when the chucking button is positioned in the releasing position, the rod body of the chucking button being disengaged from the engaging section, whereby the rotary shaft can freely rotate and the chucking section is aligned with the front end of the slide way; and a link mounted in the slide way of the main body and slidable along the slide way; a resilient member being disposed in the slide way to resiliently abut against the link, whereby in normal state, the resilient member resiliently pushes the link to move rearward; when the activation switch is positioned in the shutoff position, the link being rearward moved to a releasing position and the front end of the link being not chucked with the chucking button; when the activation switch is positioned in the activation position, the link is pushed to move forward, whereby the front end of the link is chucked with the chucking section of the chucking button.

2. The grinder as claimed in claim 1, wherein the activation switch is a trigger pivotally arranged on a circumference of the main body.

3. The grinder as claimed in claim 2, further comprises a conduit and an operation rod; the conduit is formed in the main body, the conduit has an open end directed to the trigger; a rear end of the slide way communicates with the conduit; the operation rod is mounted in the conduit and movable along the conduit between an operation position and a releasing position, one end of the operation rod protruding out of the conduit and connected with the trigger, whereby when the trigger is positioned in the shutoff position, the operation rod is positioned in the releasing position, while when the trigger is shifted and positioned in the activation position, the operation rod is moved inward to forward push the link to the chucking position.

4. The grinder as claimed in claim 3, wherein a small diameter section is formed on the operation rod, when the operation rod is positioned in the releasing position, the small diameter section is aligned with the rear end of the slide way, whereby the rear end of the link is moved into the conduit to contact with the small diameter section.

5. The grinder as claimed in claim 3, wherein the outer end of the operation rod contacts with the trigger; a resilient member is mounted between the main body and the operation rod, whereby in normal state, the resilient member resiliently forces the operation rod to outward move to the releasing position.

6. The grinder as claimed in claim 4, wherein the outer end of the operation rod contacts with the trigger; a resilient member is mounted between the main body and the operation rod, whereby in normal state, the resilient member resiliently forces the operation rod to outward move to the releasing position.

7. The grinder as claimed in claim 1, wherein a button chamber is formed on the circumference of the main body; the activation switch is a rotary switch rotatably disposed in a switch chamber, the rotary switch is rotatable between the shutoff position and the activation position; the rear end of the slide way communicates with the button chamber; the rear end of the link contacts with the rotary switch.

8. The grinder as claimed in claim 7, wherein a recess is formed on the circumference of the rotary switch, when the rotary switch is positioned in the shutoff position, the recess is aligned with the rear end of the slide way and the rear end of the link contacts with the recess.

9. The grinder as claimed in claim 1, wherein the activation switch is mounted at a rear end of the main body and movable along the axis of the main body, when the activation switch is moved rearward, the activation switch is positioned in the shutoff position, while when the activation switch is moved forward, the activation switch is positioned in the activation position; the rear end of the slide way being aligned with a front end face of the switch; the rear end of the link contacts with the switch.

10. The grinder as claimed in claim 1, wherein a resilient member is arranged between the chucking button and the main body, whereby in normal state, the chucking button is resiliently forced by the resilient member and kept in the releasing position.

11. The grinder as claimed in claim 1, wherein the passage has a first portion and a second portion in parallel to each other, the first portion communicates with the shaft chamber; the front end of the slide way communicates with the second portion; the chucking button has a first rod body and a second rod body, the first rod body is fitted in the first portion of the passage, while the second rod body is fitted in the second portion of the passage; the chucking section is formed on the second rod body; the first rod body of the chucking button is engageable with the rotary shaft.

12. The grinder as claimed in claim 11, wherein a resilient member is disposed in the second portion of the passage to abut against the second rod body of the chucking button, whereby in normal state, the chucking button is kept in the releasing position.

13. The grinder as claimed in claim 1, wherein the passage further has a cavity formed on the circumference of the main body; the chucking button further has a button section connected with the rod body, the button section is accommodated in the cavity.

14. The grinder as claimed in claim 1, wherein the engaging section of the rotary shaft is a cave, whereby the rod body of the chucking button is inserted into the cave to engage with the rotary shaft.

15. The grinder as claimed in claim 11, wherein the engaging section of the rotary shaft is a cave, whereby the first rod body of the chucking button is inserted into the cave to engage with the rotary shaft.

16. The grinder as claimed in claim 1, wherein the engaging section is a dent formed on the circumference of the rotary shaft; the rod body of the chucking button extending into the shaft chamber and being formed with a depression, when the chucking button is positioned in the releasing position, the depression is aligned with the rotary shaft, when the chucking button is positioned in the chucking position, the rod body is engaged with the engaging section of the rotary shaft.

17. The grinder as claimed in claim 11, wherein the engaging section is a dent formed on the circumference of the rotary shaft; the first rod body of the chucking button extending into the shaft chamber and being formed with a depression, when the chucking button is positioned in the releasing position, the depression is aligned with the rotary shaft, when the chucking button is positioned in the chucking position, the first rod body is engaged with the engaging section of the rotary shaft.

18. The grinder as claimed in claim 1, wherein the chucking section of the chucking button is a dent.

19. The grinder as claimed in claim 11, wherein the chucking section of the chucking button is a dent.

* * * * *